US006910932B2

(12) United States Patent
Brumleve et al.

(10) Patent No.: US 6,910,932 B2
(45) Date of Patent: Jun. 28, 2005

(54) SOLID MERCURY RELEASING MATERIAL AND METHOD OF DOSING MERCURY INTO DISCHARGE LAMPS

(75) Inventors: Timothy R. Brumleve, Urbana, IL (US); Duane A. Stafford, Champaign, IL (US); Steven C. Hansen, Urbana, IL (US); Katsumi Fukutome, Hyogo (JP)

(73) Assignee: Advanced Lighting Technologies, Inc., Solon, OH (US)

( * ) Notice: Subject to any disclaimer, the term of this patent is extended or adjusted under 35 U.S.C. 154(b) by 571 days.

(21) Appl. No.: 09/832,875

(22) Filed: Apr. 12, 2001

(65) Prior Publication Data

US 2001/0038264 A1 Nov. 8, 2001

Related U.S. Application Data

(60) Provisional application No. 60/196,308, filed on Apr. 12, 2000.

(51) Int. Cl.[7] ..... H01J 9/38
(52) U.S. Cl. ..... 445/9; 445/26
(58) Field of Search ..... 313/565, 550, 313/546, 547; 445/9, 26, 31, 55, 70, 73, 10, 19, 38, 39

(56) References Cited

U.S. PATENT DOCUMENTS

| | | | | |
|---|---|---|---|---|
| 3,318,649 A | | 5/1967 | Keller, Jr. et al. | |
| 3,657,589 A | | 4/1972 | Della Porta et al. | |
| 3,676,534 A | | 7/1972 | Anderson | |
| 3,722,976 A | | 3/1973 | Porta et al. | |
| 3,957,328 A | * | 5/1976 | Van Der Wolf et al. | 445/9 |
| 4,145,634 A | | 3/1979 | Evans et al. | |
| 4,201,739 A | | 5/1980 | Anderson | |
| 4,389,201 A | * | 6/1983 | Hansler et al. | 445/26 |
| 4,449,948 A | * | 5/1984 | Anderson | 445/18 |
| 4,615,846 A | | 10/1986 | Yoshino et al. | |
| 4,808,136 A | | 2/1989 | Schuster | |
| 6,048,241 A | * | 4/2000 | Traksel et al. | 445/9 |

FOREIGN PATENT DOCUMENTS

| | | |
|---|---|---|
| DE | 287592 | 2/1991 |

* cited by examiner

*Primary Examiner*—Joseph Williams
*Assistant Examiner*—Peter Macchiarolo
(74) *Attorney, Agent, or Firm*—Duane Morris, LLP; D. Joseph English

(57) ABSTRACT

A solid mercury-releasing material and a method of dispensing precise amounts of mercury into the light emitting chamber of a discharge lamp without introducing the other dispenser components into the chamber are disclosed. The solid material includes an amalgam of one or more metals and mercury in the form of particles of high purity, uniform size and uniform composition.

41 Claims, 5 Drawing Sheets

SOLID MERCURY RELEASING MATERIAL AND METHOD OF DOSING MERCURY INTO DISCHARGE LAMPS

CLAIM OF PRIORITY

This application claims the priority of U.S. Provisional patent application Ser. No. 60/196,308 filed Apr. 12, 2000.

BACKGROUND OF THE INVENTION

The present invention relates generally to dosing mercury in discharge lamps. More specifically, the present invention relates to dosing a small quantity of mercury into the light emitting chamber of a discharge lamp using solid mercury-containing dispensers in the form of particles of high purity, uniform size, and uniform composition.

Discharge lamps such as cold cathode fluorescent lamps having a vaporizable lamp fill including mercury are commonly used for computer display backlighting and instrumentation illumination such as in an automobile or airplane. In the manufacture of such discharge lamps, it is necessary to introduce very small amounts of mercury into the light emitting chamber of the lamp. For example, a cold cathode fluorescent lamp typically includes about 0.1 mg up to about 10 mg of mercury depending on the size of the lamp. However, some discharge lamps may require as little as 0.001 mg or as much as 50 mg of mercury. While it is possible to introduce liquid mercury directly into the chamber, it is very difficult to obtain precise doses of such small quantities of mercury using this method due to the high surface tension of mercury. Consequently, lamps dosed by this method usually include more mercury than is needed for operation of the lamp leading to concerns with meeting government regulations on mercury content and to environmental concerns in the disposal of the lamps. Direct introduction of liquid mercury into the chamber may also be impeded by retention of small droplets of mercury on the surface of the dosing tube.

There remains the practical question of how to dose such small quantities of mercury into the light emitting chamber of a discharge lamp. It is known to dose the mercury using an amalgam which releases mercury when the temperature of the amalgam is elevated. For example, U.S. Pat. No. 3,957,328 to van der Wolfe et al. discloses a method of dosing mercury into the light emitting chamber of a lamp wherein an indium amalgam in a liquid or paste form is introduced and spread about the interior surface of an exhaust tube to increase the surface area thereof, and then the exhaust tube is connected in fluid communication with the light emitting chamber of the lamp. The amalgam is heated to effect release of the mercury from the amalgam into the chamber, leaving the dispensed indium in the exhaust tube for removal from the lamp therewith.

The method disclosed by van der Wolfe et al. suffers from several disadvantages. The amalgam is in the form of a liquid or paste and thus the precise amount of amalgam must be measured prior to introducing the amalgam into the exhaust tube of the lamp. Further, the amalgam must be introduced into the exhaust tube with the aid of a syringe and then the glob of amalgam must be spread evenly about the inner surface of the tube. The spreading of the amalgam requires rotation of the tube and, in some instances, a jet of gas such as air is required to sufficiently spread the amalgam.

To further facilitate the spreading of the amalgam in the exhaust tube, the amalgam is introduced into the tube separate from the lamp prior to connecting the tube in fluid communication with the light emitting chamber of the lamp.

Certain process steps in the manufacture of the lamp must be performed after the connection of the exhaust tube (containing the amalgam) and require parts of the lamp to be exposed to high temperatures. Thus the amalgam may be exposed to high temperatures during certain lamp process steps which may lead to premature release of mercury from the amalgam, and cooling of the amalgam may be required to prevent premature release of the mercury.

Still further, the amalgam paste is susceptible to contamination by air and moisture which may lead to the introduction of contaminates into the chamber during release of the mercury.

Thus there remains a need for a method of dosing small quantities of mercury into discharge lamps in an easily fabricated and dosed solid mercury-containing dispenser of high purity, uniform size, and uniform composition.

Accordingly, it is an object of the present invention to obviate the deficiencies of the known prior art and to provide a novel mercury-containing dispenser and method.

It is another object of the present invention to provide a novel particle suitable for dispensing small quantities of mercury into a discharge lamp.

It is yet another object of the present invention to obviate the deficiencies of the known prior art and to provide a novel method of dosing mercury into a discharge lamp.

It is still another object of the present invention to provide a novel method of dosing a discharge lamp with small quantities of mercury dispensed from a solid amalgam particle.

It is a further object of the present invention to provide a method of dosing a lamp with small quantities of mercury which reduces the introduction of impurities into the lamp.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
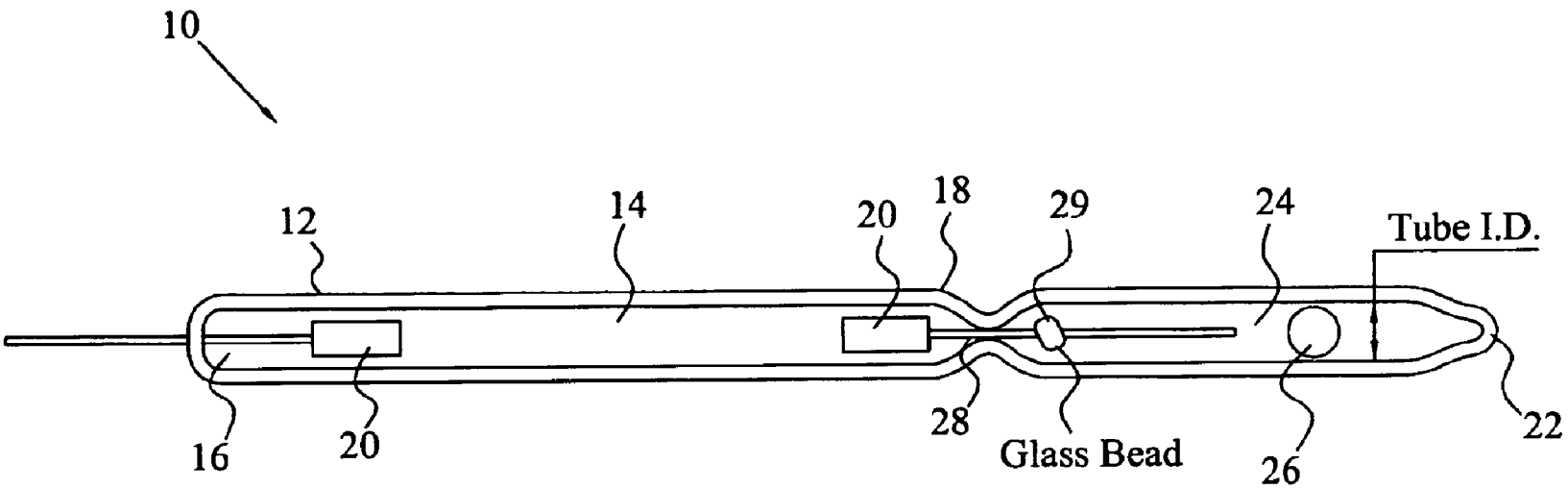
FIG. 1 is a schematic illustrating a discharge lamp having an amalgam particle contained within the exhaust tube according to the present invention.

The present invention finds utility in dosing the desired quantities of mercury in all types and sizes of discharge lamps. By way of example only, certain aspects of the present invention may be easily understood in the embodiment of an amalgam particle and method of dosing small quantities of mercury in a cold cathode discharge lamp in which the lamp fill material is dosed into the light emitting chamber through an extended tubular end portion of the lamp body.

It has been discovered that a mercury-containing dispenser suitable for dispensing a small quantity of mercury into the light emitting chamber of a discharge lamp may take the form of one or more solid particles formed from a molten mixture of mercury and one or more amalgamative metals. The temperature of the particle may be elevated to effect release of substantially all of the mercury contained therein without any substantial release of the one or more amalgamative metals.

The one or more amalgamative metals must form a stable amalgam at room temperature and must release essentially only mercury when the temperature of the amalgam is elevated to a temperature within a certain temperature range. The temperature range in which the amalgam releases essentially only mercury depends on the composition of the amalgam, a temperature readily determined by one having skill in the art. The amalgamative metals suitable for forming the solid mercury dispenser include zinc, tin, indium, lead, copper, cadmium, bismuth, silver, and gold, and combinations thereof such as alloys.

The particles may be formed by admixing the desired quantity of mercury with the one or more amalgamative metals, melting the admixture, and forming particles from the molten admixture. The amount of amalgamative metal in the particle is determined by the desire to have a particle large enough to facilitate handling and prevent introduction of the particle and the dispensed amalgamative metal into the light emitting chamber, yet not too large that the particle is precluded from being placed in close proximity to the light emitting chamber during the mercury dosing process.

U.S. Pat. No. 3,676,534 to Anderson dated July, 1972 and assigned to the assignee of the present invention, the content of which is hereby incorporated by reference, discloses a process for forming uniformly sized particles by forcing a homogeneous melt through an orifice of known diameter at a known velocity and acoustically or electromechanically breaking the molten jet into controlled lengths.

An alternative process is described in the Anderson U.S. Pat. No. 4,201,739 dated May, 1980 and assigned to the assignee of the present invention, the content of which is hereby incorporated by reference. In that Anderson patent, particles are formed by the controlled wetting of an orifice which allows the dripping of a molten admixture to form spheres of a larger diameter.

Yet another process for forming particles from a molten admixture of materials is disclosed in Yoshino U.S. Pat. No. 4,615,846, the content of which is hereby incorporated by reference.

Particles suitable for dispensing mercury into discharge lamps may be formed by mixing mercury with one or more amalgamative metals, melting the admixture, and forming the particles from the molten admixture according to the processes disclosed by Anderson and Yoshino et al., or any other suitable process for forming particles from a molten admixture of materials. Particles containing as little as 0.001 mg or as much as 50 mg of mercury and ranging between 0.5 and 75 weight percent mercury may be produced. Particles for introducing mercury into cold cathode fluorescent lamps typically include between about 0.1 mg and 10 mg of mercury.

The particles are typically produced as spheres having an average diameter between about 50 and about 3,000 microns, and preferably between about 150 and about 1,200 microns. However, such particles may be produced in the dripping process described above with a diameter between about 1600 and about 3000 microns, preferably between about 1750 and about 2500 microns. The process of Yoshino et al. may produce particles having diameters greater than 1000 microns.

With reference to FIG. 1, a cold cathode discharge lamp 10 includes a lamp body 12 formed from light transmissive material such as glass. The body 12 forms a light emitting chamber 14 intermediate end portions 16,18. A pair of spaced apart electrodes 20 are positioned coaxially, one in each end portion. The body 12 is elongated beyond the electrode 20 positioned therein and may be sealed at the end portion 22 thereof to form a mercury dispensing chamber 24. The chamber 24 may be sealed by tipping off the end portion 22 or by connection of a gas supply hose (not shown) to the end portion 22. Fluid communication between the mercury dispensing chamber 24 and the light emitting chamber 14 is maintained through the passage 28 until the mercury is dispensed into the chamber 14.

One or more mercury dispensing particles 26 may be placed within the mercury dispensing chamber 24 prior to sealing the end portion 22. The particles 26 must be small enough to be contained within the chamber 24, but large enough to prevent passage of the particles 26 and the dispensed amalgamative metal into the chamber 14 through the fluid passage 28. An impediment to the passage of the particle 26 through the passage 28 such as the glass bead 29 may be positioned within the chamber 24.

Once the particles are sealed within the chamber 24, the temperature of the particles 26 may be elevated to effect release of the mercury from the particles 26 by locally heating the portion of the chamber 24 containing the particles 26. The chamber 24 may be locally heated by any conventional means such as a locally directed flame or radiation. The temperature differential between the locally heated chamber 24 and the chamber 14 will drive the released mercury vapor into the cooler chamber 14 through the fluid passage 28 where the mercury will condense.

The particles must be heated to a temperature which is sufficient to effect release of mercury, but limited to prevent release of amalgamative metal from the particle and limited to prevent the softening of the lamp components formed from glass. The desired temperature depends on the composition of the particles, but is typically within the range of about 250° C. to about 425° C. Desirably, substantially all of the mercury contained in the particle is released in less than four minutes after the temperature of the particle is elevated.

Once the mercury is dispensed into the chamber 14, the chamber 14 may be sealed by conventional means such as shrink sealing the end portion 18 at the portion forming the passage 28, and the elongated end portion 18 may be removed beyond the shrink seal along with the residue of the dispensed amalgamative metal.

In the preferred embodiment of the present invention for use in dispensing mercury into a cold cathode fluorescent lamp, the particles are formed by admixing mercury with bismuth and tin, melting the admixture, and forming particles from the melted admixture.

The particles of the present invention provide a solid mercury-containing dispenser which may be easily dosed into close proximity to the light emitting chamber of a discharge lamp so that the mercury may be released from the dispenser into the chamber by heating the dispenser. The particles may be formed to include high purity, uniform size, and uniform composition. The particles are suitable for dispensing small amounts of mercury into cold cathode fluorescent lamps, as well as all sizes and types of discharge lamps including conventional fluorescent lamps, compact fluorescent lamps, and metal halide lamps.

Further, the ease of positioning the particles in close proximity to the chamber allows placement of the particles after the completion of the steps in the manufacture of the lamp which may expose the particles to elevated temperatures, thereby preventing the premature release of mercury from the particles.

EXAMPLE 1

Figure 2:
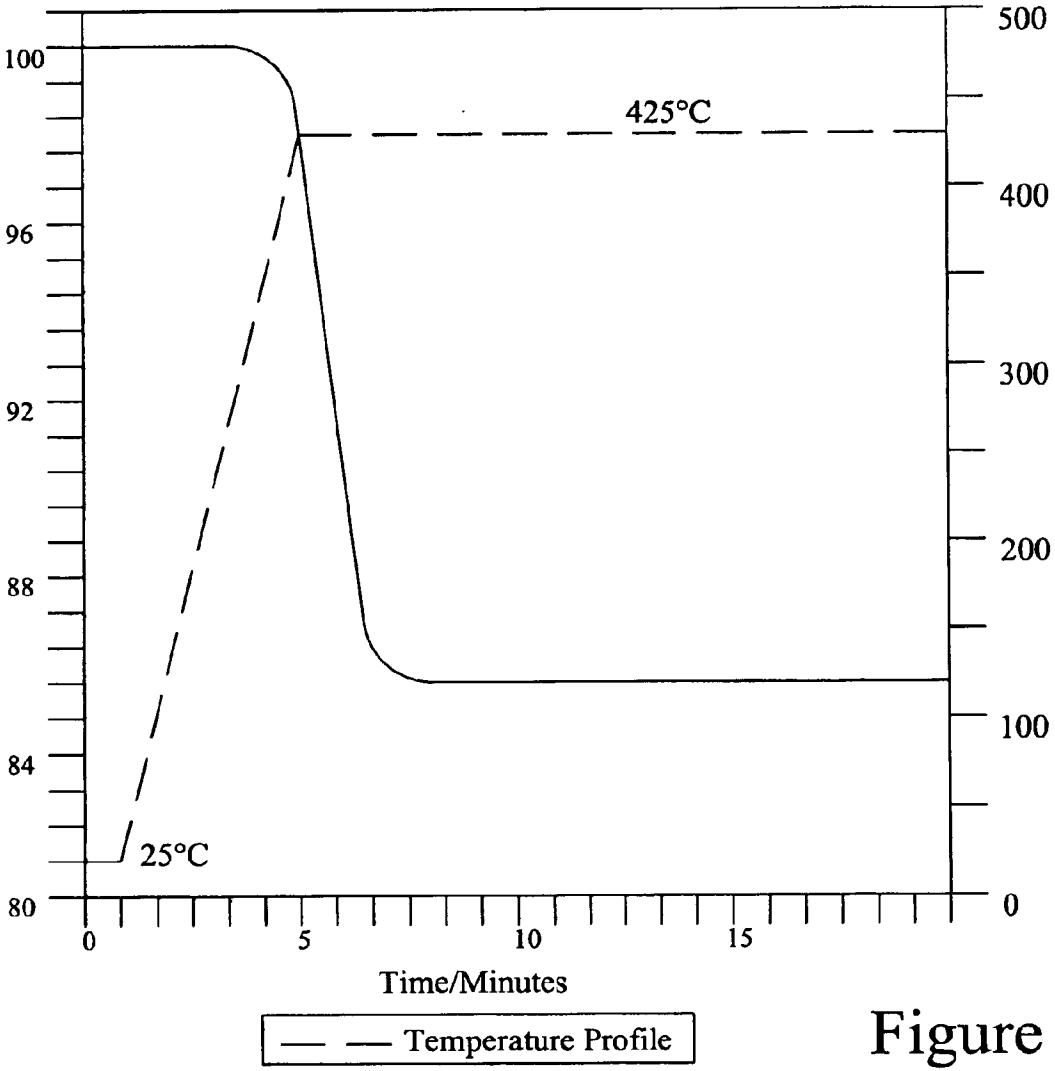
FIG. 2 is a graphical illustration of the mercury evolution in a reduced pressure atmosphere from particles formed according to Example 1 of the present invention.

A particle is formed by admixing 16 g mercury with 48 g bismuth and 36 g tin, melting the admixture into a homogeneous melt, and solidifying the melt into 53 mg particles having a composition of about 16 weight percent mercury. The particles formed are generally spherical and have a diameter of about 2200 $\mu$m and a quantity of about 8.5 mg of mercury. FIG. 2 illustrates the mercury evolution from the particle when subjected to the illustrated temperature cycle in an atmosphere of argon at 1.4 torr.

EXAMPLE 2

Figure 3:
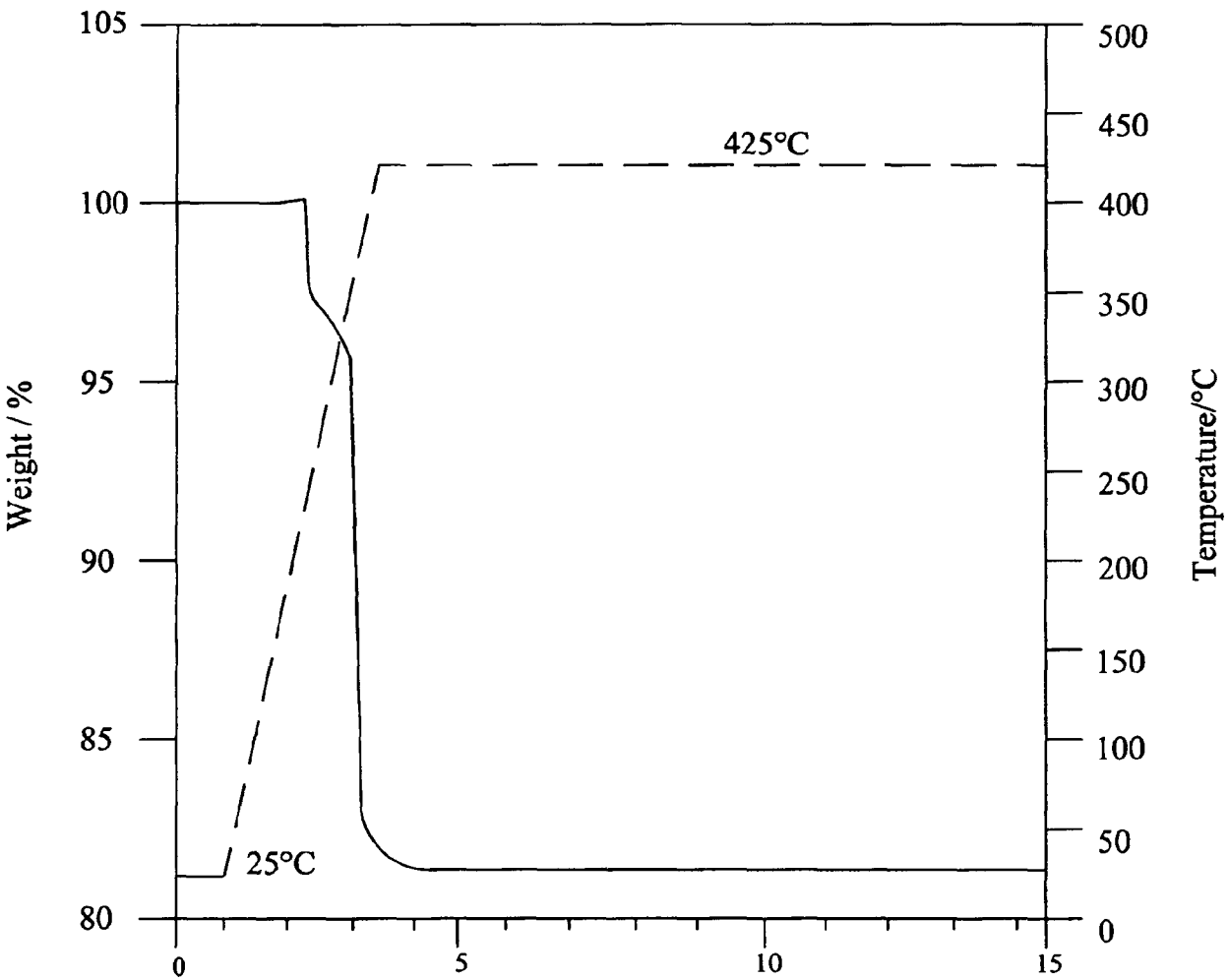
FIG. 3 is a graphical illustration of the mercury evolution in a reduced pressure atmosphere from particles formed according to Example 2 of the present invention.

A particle is formed by admixing 15 g mercury with 85 g indium, melting the admixture into a homogeneous melt, and solidifying the melt into 7.7 mg particles having a composition of about 15 weight percent mercury. The particles formed are generally spherical and have a diameter of about 1230 $\mu$m and a quantity of about 1.2 mg of mercury. FIG. 3 illustrates the mercury evolution from the particle when subjected to the illustrated temperature cycle in an atmosphere of argon at 1.6 torr.

EXAMPLE 3

Figure 4:
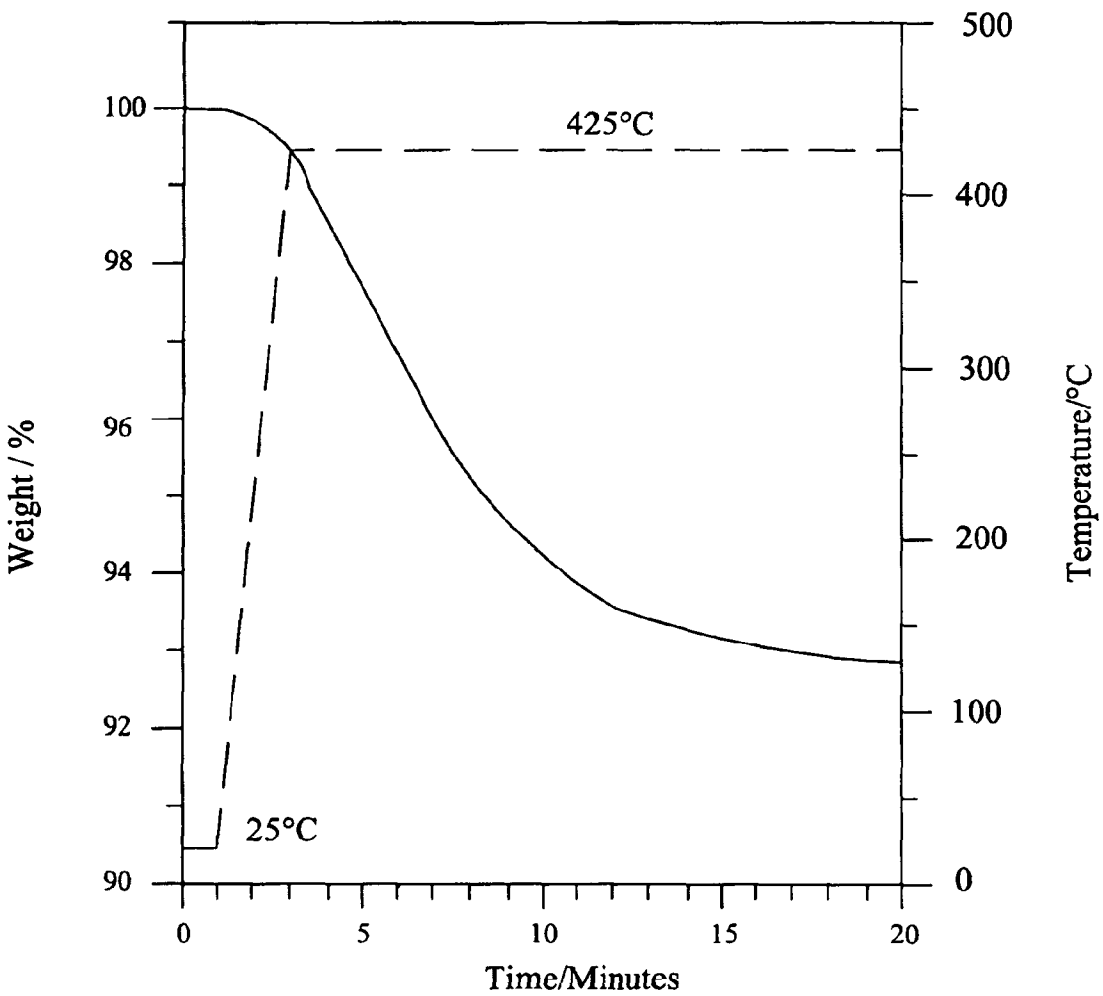
FIG. 4 is a graphical illustration of the mercury evolution in a reduced pressure atmosphere from particles formed according to Example 3 of the present invention.

A particle is formed by admixing 15.8 mg mercury with 184.2 g lead, melting the admixture into a homogeneous melt, and solidifying the melt into 6 mg particles having a composition of about 7.9 weight percent mercury. The particles formed are generally spherical and have a diameter of about 1000 $\mu$m and a quantity of about 0.47 mg of mercury. FIG. 4 illustrates the mercury evolution from the particle when subjected to the illustrated temperature cycle in an atmosphere of argon at 1.4 torr.

EXAMPLE 4

Figure 5:
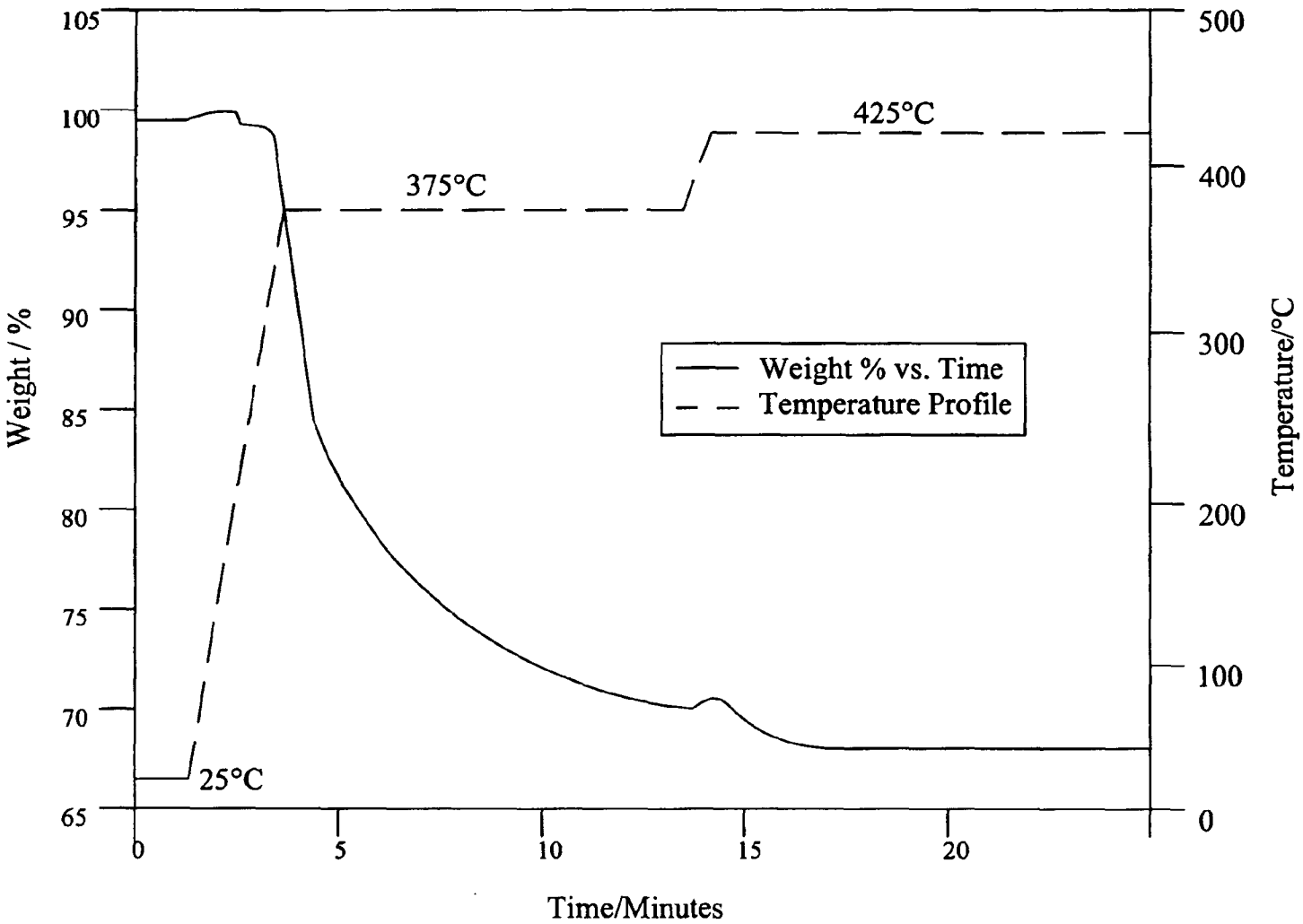
FIG. 5 is a graphical illustration of the mercury evolution in a reduced pressure atmosphere from particles formed according to Example 4 of the present invention.

A particle is formed by admixing 300 g mercury with 700 g zinc, melting the admixture into a homogeneous melt, and solidifying the melt into 4.35 mg particles having a composition of about 30 weight percent mercury. The particles formed are generally spherical and have a diameter of about 1000 $\mu$m and a quantity of about 1.3 mg of mercury. FIG. 5 illustrates the mercury evolution from the particle when subjected to the illustrated temperature cycles in an atmosphere of argon at 1.4 torr.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. In a method of dispensing mercury into the light emitting chamber of a discharge lamp including the steps of providing the mercury in an amalgam, introducing the amalgam into a mercury dispensing chamber having fluid communication with the interior of the light emitting chamber, heating the amalgam to a temperature sufficient to effect release of the mercury from the amalgam into the light emitting chamber, sealing the mercury within the light emitting chamber, and removing the amalgamative metal and mercury dispensing chamber from the lamp, the improvement wherein the mercury is introduced into the mercury dispensing chamber in the form of one or more particles of an amalgam of one or more amalgamative metals.

2. The method of claim 1 wherein the amalgamative metals include one or more metals from the group consisting of Zn, Pb, Sn, Cu, Cd, In, Bi, Ag, and Au.

3. The method of claim 2 wherein the amalgamative metals include one or more metals from the group consisting of Bi, Sn, and Pb.

4. The method of claim 1 wherein the one or more particles comprise Bi.

5. The method of claim 1 wherein the one or more particles comprise more than about 0.5 weight percent mercury but not more than about 75 weight percent mercury.

6. The method of claim 5 wherein the one or more particles comprise more than about 3.0 weight percent mercury but not more than about 40 weight percent mercury.

7. The method of claim 6 wherein the amalgamative metal comprises Bi.

8. The method of claim 1 wherein the temperature of the particles is elevated to at least about 250° C. to effect release of the mercury therefrom.

9. The method of claim 1 wherein the temperature of the particles is elevated to a temperature greater than about 250° C. but less than about 450° C. to thereby effect release of the mercury therefrom.

10. The method of claim 1 wherein each of the one or more particles is generally spherical.

11. The method of claim 10 wherein the diameter of the generally spherical particles is at least about 50 $\mu$m but not greater than about 3000 $\mu$m.

12. The method of claim 11 wherein the diameter of the generally spherical particles is at least about 150 $\mu$m but not greater than about 1200 $\mu$m.

13. The method of claim 1 wherein the temperature of the particles is elevated about 400° C. in about two minutes.

14. The method of claim 13 wherein the temperature of the particles is held substantially constant for at least two minutes after being elevated.

15. In a method of dosing mercury into the light emitting chamber of a discharge lamp including the step of heating an amalgam retained outside of the chamber to thereby effect the release of mercury from the amalgam into the chamber with the introduction of essentially no amalgamative metal into the chamber, the improvement wherein the amalgam is in the form of one or more particles.

16. The method of claim 15 wherein the one or more particles include one or more amalgamative metals.

17. The method of claim 16 wherein the amalgamative metals include one or more metals from the group consisting of Zn, Pb, Sn, Cu, Cd, In, Bi, Ag, and Au.

18. The method of claim 17 wherein the amalgamative metals include one or more metals from the group consisting of Bi, Pb, and Sn.

19. The method of claim 18 wherein the one or more particles include Bi and Sn.

20. The method of claim 18 wherein the one or more particles include Pb.

21. The method of claim 15 wherein the amalgam is retained in the exhaust tube of the lamp.

22. The method of claim 15 wherein the amalgamative metal is no longer retained after the step of effecting the release of mercury from the amalgam.

23. The method of claim 15 wherein the particles are generally spherical and generally uniform in size and composition.

24. In a method of dosing mercury into the light emitting chamber of a discharge lamp including the steps of providing an amalgam, retaining the amalgam exterior to the chamber, elevating the temperature of the amalgam to thereby effect the release of mercury from the amalgam, providing passage for the released mercury into the chamber, and removing the dispensed amalgamative metal from the lamp, the improvement wherein the amalgam is in the form of one or more particles.

25. The method of claim 24 wherein the one or more particles are retained in a mercury dispensing chamber in fluid communication with the light emitting chamber.

26. The method of claim 25 wherein the mercury discharge chamber comprises a tubular section open at one end to the interior of the light emitting chamber and closed at the other end.

27. In a method of making a discharge lamp including the steps of positioning an amalgam in sufficient proximity to the light emitting chamber of the lamp so that mercury released from the amalgam will pass through an opening in the chamber wall into the interior of the chamber, heating certain parts of the lamp to temperatures greater than the temperature above which the amalgam will release mercury without releasing any mercury from the amalgam, and heating the amalgam to effect release of mercury, the improvement wherein the step of heating certain parts of the lamp is performed before the steps of positioning and heating the amalgam.

28. The method of claim 27 wherein the amalgam is in the form of one or more particles of one or more amalgamative metals.

29. The method of claim 28 wherein the step of positioning the amalgam comprises the step of introducing the one or more particles into a mercury dispensing chamber in fluid communication with the light emitting chamber, and retaining the particles within the mercury dispensing chamber.

30. The method of claim 29 wherein one end of the mercury dispensing chamber is open to the interior of the light emitting chamber, and the other end thereof is fused closed after the one or more particles are positioned therein.

31. The method of claim 28 wherein the temperature of the particles is elevated about 400° C. in about two minutes and then held substantially constant for at least two minutes.

32. The method of claim 31 wherein the temperature of the particles is held substantially constant for at least seven minutes.

33. A method of making a discharge lamp comprising the steps of:

a. providing a lamp body forming a light emitting chamber in fluid communication with a mercury dosing chamber, the mercury dosing chamber being open to the light emitting chamber at one end and open to the atmosphere surrounding the lamp body at the other end;

b. introducing one or more particles into the mercury dosing chamber through the other end of the chamber, the particles being formed from mercury and one or more amalgamative metals;

c. sealing the other end of the mercury discharge chamber;

d. elevating the temperature of the one or more particles to effect release of mercury from the particles into the light emitting chamber;

e. sealing the light emitting chamber to thereby contain the mercury released into the chamber; and f. removing the mercury dosing chamber and residue of the particles from the lamp body.

34. A discharge lamp comprising a light emitting chamber, a mercury dosing chamber in fluid communication with said light emitting chamber, and one or more particles comprising an amalgam of one or more amalgamative metals retained within said mercury dosing chamber, each of said particles being suitable for releasing essentially only mercury when the temperature of the particle is elevated to a predetermined temperature for a predetermined period of time.

35. The discharge lamp of claim 34 wherein said particles comprise one or more of the metals from the group consisting of Zn, Pb, Sn, Cu, Cd, In, Bi, Ag, and Au.

36. The discharge lamp of claim 34 comprising a tubular passage between said mercury dosing chamber and said light emitting chamber, said passage being small enough to prevent passage of the particles from said mercury dosing chamber into said light emitting chamber.

37. The discharge lamp of claim 34 wherein said chambers are formed from light transmissive material.

38. The discharge lamp of claim 37 wherein said chambers are formed from glass.

39. The discharge lamp of claim 37 wherein said chambers are formed from quartz or ceramic material.

40. The discharge lamp of claim 34 wherein said one or more particles cumulatively include at least about 0.001 mg but not more than about 50 mg mercury.

41. The discharge lamp of claim 40 wherein said one or more particles cumulatively include at least about 0.1 mg but not more than about 10 mg mercury.

* * * * *